United States Patent [19]

Tolmie

[11] 3,945,118

[45] Mar. 23, 1976

[54] SHAVER INNER CUTTER

[75] Inventor: Robert J. Tolmie, Fairfield, Conn.

[73] Assignee: Sperry Rand Corporation, Bridgeport, Conn.

[22] Filed: Nov. 7, 1974

[21] Appl. No.: 521,724

Related U.S. Application Data

[62] Division of Ser. No. 414,175, Nov. 8, 1973, Pat. No. 3,858,461.

[52] U.S. Cl. ..... 30/346.51

[51] Int. Cl.[2] ..... B26B 19/04

[58] Field of Search ..... 30/346.51; 76/104 R

[56] References Cited

UNITED STATES PATENTS

| | | | |
|---|---|---|---|
| 2,833,033 | 5/1958 | Heyek | 30/346.51 X |

FOREIGN PATENTS OR APPLICATIONS

| | | | |
|---|---|---|---|
| 1,160,015 | 7/1969 | United Kingdom | 30/346.51 |
| 1,728,376 | 12/1971 | Germany | 30/346.51 |

*Primary Examiner*—Al Lawrence Smith
*Assistant Examiner*—Gary L. Smith
*Attorney, Agent, or Firm*—Charles R. Miranda

[57] ABSTRACT

A landless inner cutter having a body portion which is made from a single piece of metallic material such as a flat strip of sheet metal. The inner cutter has a body portion including a pair of longitudinal flanges provided with ledges which support a plurality of parallel, arch-shaped, cutter tooth blade sections. The blade sections span the space between the flanges and are disposed normal to the same. In addition, the inner cutter includes a support which is also made of a single piece of sheet metal, to which the blade sections are individually secured so as to rigidly maintain the same parallel to one another. The blade sections are formed in a flat strip of sheet metal in order to form a landless inner cutter. Material if formed from the strip to provide the same with a first archlike edge which has a rise and a span. A second archlike edge is formed in the strip which is longitudinally displaced from the first edge such that the span of the second edge intersects the rise of the first edge. Bending the resulting arch-shaped strip material or blade section out of and normal to the plane of the strip, provides a normally disposed, arch-shaped blade section. Successive repetition of the cutting and bending provides a plurality of equidistantly-spaced blade sections in the strip.

6 Claims, 5 Drawing Figures

10
12
14
16
18
20
22
23
24
25
26
28
30
32
34
36
38
39
40
42
44

SHAVER INNER CUTTER

BACKGROUND OF THE INVENTION

This is a division of application Ser. No. 414,175, filed Nov. 8, 1973.

This invention is concerned with inner cutters for electric dry shavers, and more particularly with a landless inner cutter having blade sections formed in a thin strip of flat metallic material so as to form a landless inner cutter, and this application is a division of U.S. application Ser. No. 414,175 filed Nov. 8, 1973, now issued to U.S. Pat. No. 3,858,461.

Prior art inner cutters are sometimes made of light-weight sheet metal parts so as to reduce the mass of the inner cutter, which results in lessening the vibration engendered by the inner cutter as it is reciprocated relative to an outer cutter for shearing hair. The various prior art methods of fabricating such light-weight inner cutters have included the steps of forming a plurality of generally C-shaped, equidistantly longitudinally spaced cuts in a strip of sheet metal material, and bending the material within the perimeters of the respective cuts out of the plane of the strip, so as to form a plurality of parallel, upstanding tabs and thus blade sections. In such processes a given blade section is separated from an adjacent blade section by a transversely-extending portion of strip material remaining in the plane of the strip, i.e., a supporting land, and by a space equivalent to the height of the blade section bent out of the plane of the strip. As a consequence, the number of blade sections of a particular height which can be formed, in a given length of strip material, depends on the width of the space occupied by the supporting lands between the various blade sections.

Although the blade sections have been more closely spaced adjacent to one another by eliminating the supporting lands between the blade sections, the prior art processes for doing so are expensive and time consuming due to the necessity of reverting to processes which include the steps of cutting of the blade sections completely out of the strip of sheet metal, aligning them with one another and individually separately securing them to a supporting member or mount. In some instances the mount has consisted of a plurality of parallel rods which are passed through openings provided in the aligned blade sections and then secured to the blade sections, for example, as by welding. In other instances the mount has consisted of an elongated bar having equidistantly longitudinally-spaced, transverse cuts, within which the blade sections are individually mounted and secured in place by means of a suitable adhesive.

An object of this invention is to provide a novel landless inner cutter;

Another object is to provide an inner cutter for an electric shaver by forming blade sections in a flat strip of metallic material without forming lands between the blade sections;

A further object is to provide an inexpensive inner cutter by forming closely spaced blade sections in a flat strip of sheet metal material for forming a landless inner cutter for a shaver; and A still further object is to provide an improved inner cutter having a sheet metal body, including cutter tooth blade sections which are formed in a single piece of flat sheet metal material in a manner allowing for more closely spacing the blade sections than has heretofore been possible.

SUMMARY OF THE INVENTION

This invention provides a landless inner cutter for an electric dry shaver by forming blade sections in a flat strip of metallic material for forming the landless inner cutter.

The landless inner cutter of the present invention comprises a body portion made from a strip of metallic material such as a piece of sheet metal. The body portion includes a pair of longitudinally-extending side sections and a plurality of transversely-extending, arch-shaped blade sections. The side sections each include a plurality of equidistantly longitudinally spaced ledges, each of which is disposed opposite to a ledge of the other side section and forms therewith a pair of ledges. As a consequence, the side sections, taken together, include a plurality of equidistantly longitudinally spaced pairs of ledges. The blade sections, which are each supported by a given pair of ledges, span the space between the side sections and extend normal to the same. In addition, each of the blade sections has inner and outer arch-shaped edges, and the opposite extremities of each blade section in conjunction with the side sections define spaced bends in the span of the outer arch-shaped edge of the respective blade sections. The inner cutter also includes means for securing the normally disposed blade sections parallel to one another.

The method of forming blade sections for the landless inner cutter includes the step of removing material from the strip so as to provide the same with a first transversely-extending archlike edge in the plane of the strip and between its side edges. The first archlike edge has a rise extending longitudinally of the strip and a span extending transversely of the strip. The strip is then provided with an archlike cut to form a second archlike edge in the strip which has a span that intersects the rise of the first archlike edge. The first and second edges form an arch-shaped blade section in the plane of the strip which is bent out of the plane of the strip and normal to the same. In doing so, another first archlike edge is exposed in the plane of the strip i.e., the other edge formed by the archlike cut. By repeating the cutting and bending steps a plurality of normally disposed blade sections are formed in the strip. For a complete discussion of the method of forming the aforesaid blade sections, reference is made to U.S. Pat. No. 3,858,461 mentioned hereinabove.

BRIEF DESCRIPTION OF THE DRAWINGS

As shown in the drawings, wherein like reference numerals designate like or corresponding parts throughout the several Figures.

DESCRIPTION OF THE PREFERRED EMBODIMENTS

Figures 1, 2:
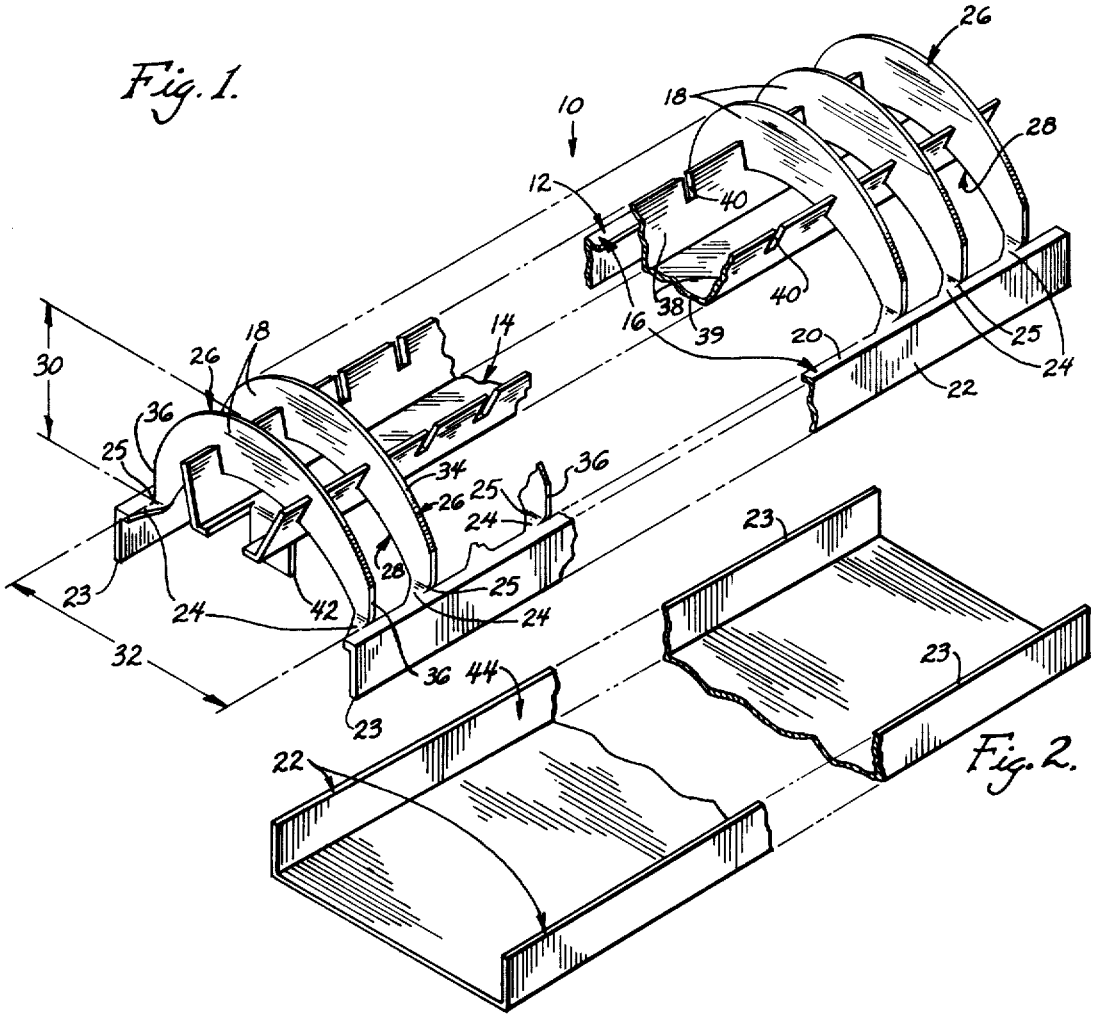
FIG. 1 is a perspective view of a landless inner cutter for a shaver, the inner cutter including an elongated body portion having a pair of longitudinal side sections and a plurality of transverse blade sections, and including a member for securing the blade sections parallel to one another.
FIG. 2 is a perspective view of the underside of a typical strip of sheet metal material prior to forming the blade sections in the strip so as to form the body portion of the inner cutter of FIG. 1.
Figure 3:
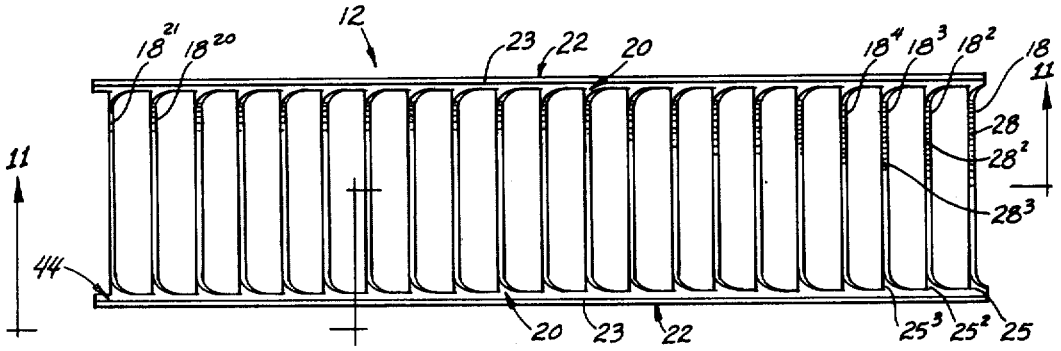
FIG. 3 is an enlarged bottom plan view of the inner cutter of FIG. 1.

As shown in FIG. 1, a shaver inner cutter 10, according to the invention, generally includes a body portion 12 and a body supporting portion 14. The body portion 12 is an elongated part of the inner cutter 10 which includes a pair of straight, longitudinally-extending side sections 16 and a plurality of arch-shaped, transversely-extending blade sections 18.

For rigidity purposes, the side sections 16 (FIG. 1) are preferably elongated flanges having an inverted L-shaped, transverse cross-section. Each of the flanges 16 has a horizontally-extending base portion 20 and a vertically-extending leg portion 22, the latter including a longitudinally-extending edge 23. The base portions 20 respectively include a plurality of generally V-shaped ledges 24 located at equidistantly spaced longitudinal intervals. Each of the ledges 24 extends inwardly of the body portion 12 and towards a like ledge 24 of the opposite base portion 20 so as to define with the same a transversely spaced pair of ledges 24. Thus the side sections 16, considered together, include a plurality of equidistantly longitudinally spaced pairs of ledges 24. Each pair of ledges 24 merges with and supports the extremities of a given arch-shaped blade section 18 and in conjunction with the same defines a pair of intersections in the form of spaced bends 25 in the plane of the base portions 20.

The blade sections 18 (FIG. 1) each have outer and inner arch-shaped peripheral edges, respectively designated 26 and 28. In FIG. 1 the outer peripheral edges 26 are suitably configured for slidably cooperating with a shaver outer cutter of the foil type (not shown). As a consequence, each of the outer peripheral edges 26 has a rise 30 and a span 32, and includes an arcuately-shaped mid-portion 34 and a pair of straight portions 36. The straight portions 36 extend parallel to one another, from the extremities of the mid-portions 34 to the ledges 24, and extend parallel to the rise 30 of the blade's outer edge 26. The arcuately-shaped mid-portions 34, considered together, are particularly conformed to a radius of curvature corresponding to that of are arcuately-shaped, longitudinally-extending segment of a cylinder (not shown). As shown in FIG. 1 the outer and inner peripheral edges 26 and 28 are non-concentric, although the inner edges 28 are substantially arcuately-shaped throughout their respective lengths. As a result, each of the blade sections 18 is wider at its mid-portion, as measured along the rise 30 of the outer peripheral edge 26, than it is at its extremities, as measured along the span 32 of the outer peripheral edge 26.

As shown in FIG. 1, the bends 25 at the extremities of a given blade section 18 are disposed in the span 32 of the outer peripheral edge 26 of the given blade section 18 and support the same normal to the plane of the base portions 20. Although the vertically-extending leg portions 22 of the side sections 16 also extend normal to the plane of the base portions 20, they do so in a direction which is opposite to that of the respective blade sections 18. As a consequence, when the inner cutter outer peripheral edges 26 are urged against a shaver outer cutter of the foil type (not shown) and the inner cutter 10 is reciprocated, the inner cutter leg portions 22 are not likely to contact the outer cutter foil (not shown) and damage the same.

The body supporting portion 14 is principally provided for rigidly maintaining the otherwise relatively weakly supported blade sections 18 parallel to one another. Although the body supporting portion 14 may take other suitable forms, it is shown in FIG. 1 as an elongated strip of metallic material which is substantially U-shaped in transverse cross-section. The body supporting portion 14 is disposed within the rise (not numbered) of the arch-shaped blade sections 18 and includes a pair of diverging side walls 38 joined to one another by a base wall 39. The side walls 38 respectively include a plurality of equidistantly longitudinally spaced slots 40 dimensioned to receive the blade sections 18. Each of the slots 40 is aligned with a slot 40 in the opposite side wall 38 so as to define with the same a pair of aligned slots 40. The adjacent pairs of slots 40 are spaced from one another a distance corresponding to the equidistant spacing between adjacent blade sections 18, so as to position the connected blade sections 18 parallel to one another. The body portion 12 is fixedly secured to the body supporting portion 14, for example, as by individually welding each of the blade sections 18 to the diverging side walls 38, so as to rigidly maintain the blade section 18 parallel to one another. According to the invention, the body supporting portion 14 is also provided with a pair of suitably longitudinally spaced depending tabs 42, one of which is shown in FIG. 1, which adapt the body supporting portion 14, and thus the inner cutter 10, to be driven in a reciprocating path of travel by an electric shaver motor (not shown).

The above described body portion 12 (FIG. 1), and particularly the blade sections 18 of the same may be formed from a strip of sheet metal material 44 as shown in FIG. 2. Leg portions 22 (FIG. 2) corresponding to those shown in FIG. 1 may be formed in the strip 44 (FIG. 2) as by longitudinally bending marginal portions 22 of the strip 44 out of the plane of the strip 44 and normal to the same. Since the leg portions 22 are shown extending upwardly in FIG. 2, rather than downwardly as in FIG. 1, the upper side of the strip 44 of FIG. 2 corresponds to the underside of the inner cutter body portion 12 of FIG. 1, before forming the blade sections 18.

Figure 4:
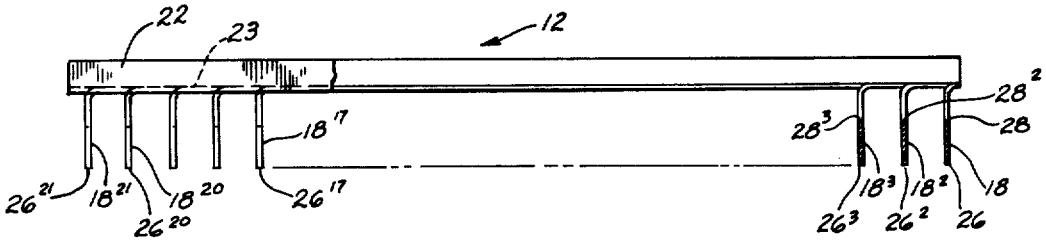
FIG. 4 is a side view, in elevation, of the inner cutter shown in FIG. 3.

In the process of forming the inner cutter body portion 12 the blade sections 18 to $18^{21}$ are aligned parallel to one another as shown in FIG. 4. At this juncture, in order to rigidly support the same, the blade sections 18 to $18^{21}$ are normally individually fixedly secured to the body supporting portion 14 (FIG. 1), as by welding. Thereafter (FIG. 4) material is removed from the outer peripheral edges 26 to $26^{21}$ of the respective blade sections 18 to $18^{21}$, for example, as by grinding the same, so as to conform the respective edges, 26 to $26^{21}$, to a desired contour, for example, that of an arcuately-shaped longitudinally extending segment of a cylinder (not shown). Of course, it is well within the scope of the invention that the step of removing material from the outer peripheral edges 26 to $26^{21}$ preceed the steps of connecting the body supporting portion 14 (FIG. 1) to the blade sections 18 to $18^{21}$ (FIG. 4), and/or that the latter be secured parallel to one another by other well-known means during the removing step.

Figure 5:
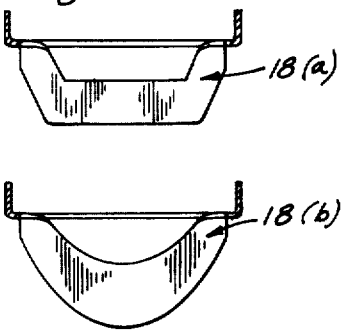
FIG. 5 is a side view, in elevation, of two alternative types of blade sections which may be formed in the strip of material of FIG. 2.

The forming of blade sections 18 in a strip of metallic material has been described in connection with forming arch-shaped blade sections 18 which are substantially arcuate in appearance, however, it is well within the scope of the invention to provide other configurations of arch-shaped blade sections 18 as shown in FIG. 5, those having the appearance of the blade sections 18(*a*) or 18(*b*).

In accordance with the objects of the invention there has been described an improved light-weight, landless inner cutter, including blade sections which are formed from a single piece of sheet metal material; and inexpensively formed blade sections allowing for more closely spaced blade sections than has heretofore been possible.

Inasmuch as certain changes may be made in the above described invention without departing from the spirit and scope of the same, it is intended that all matter contained in the above description or shown in the accompanying drawings shall be interpreted in an illustrative rather than limiting sense. And, it is intended that the following claims be interpreted to cover all the generic and specific features of the invention herein described.

What is claimed is:

1. A landless inner cutter for an electric shaver, comprising:

a. an elongated body portion formed from a flat strip of metallic material, said body portion including a pair of oppositely spaced longitudinally extending side sections and a plurality of arch-shaped transversely extending blade sections, the side sections respectively including a plurality of equidistantly longitudinally and oppositely spaced ledges, said blade sections each spanning the space between said side sections and being supported normal to said side sections by said oppositely disposed ledges;

b. each of said blade sections having outer and inner arch-shaped peripheral edges, said peripheral edges of each blade section being non-concentric to each other with the radius of the outer edge of one blade section being taken from the same center as the radius of the inner peripheral edge of the next succeeding blade section; and c. means for securing said normally disposed blade sections parallel to one another.

2. The inner cutter according to claim 1, wherein said outer peripheral edge of one blade section has the identical configuration of the inner peripheral edge of the next succeeding blade section.

3. The inner cutter according to claim 1, wherein said outer and inner peripheral edges converge toward each other to form said oppositely spaced supporting ledges.

4. The inner cutter according to claim 3, wherein said supporting ledges form a U-shaped ledge portion at spaced terminal ends of said blade sections.

5. The inner cutter according to claim 4, wherein said U-shaped ledge portions are each disposed normal to said blade section and integral with said side section.

6. The inner cutter according to claim 1, wherein said body portion and said supporting means consist of a single piece of sheet metal, and said securing means engages the inner peripheral edge and opposed surfaces of each of said blade sections to rigidly maintain said blade sections parallel, one to the other.

* * * * *